US005123473A

United States Patent [19]

Henkenjohann

[11] Patent Number: 5,123,473

[45] Date of Patent: Jun. 23, 1992

[54] ROLLER BLIND FOR WINDOWS, DOORS OR THE LIKE

[76] Inventor: Johann Henkenjohann, Oesterwieher Strasse 80, 4837 Verl 1, Fed. Rep. of Germany

[21] Appl. No.: 557,148

[22] Filed: Jul. 23, 1990

[30] Foreign Application Priority Data

Jul. 26, 1989 [DE] Fed. Rep. of Germany ..... 8909038

[51] Int. Cl.[5] ..... A47H 1/00

[52] U.S. Cl. ..... 160/264; 160/231.1

[58] Field of Search ..... 160/264, 271, 272, 273.1, 160/231.1, 231.2, 230

[56] References Cited

U.S. PATENT DOCUMENTS

| | | | |
|---|---|---|---|
| 333,408 | 12/1885 | Hale | 160/264 X |
| 484,957 | 10/1892 | Gilliam | 160/231.1 X |
| 2,200,481 | 4/1938 | Thexton | 160/264 |
| 2,803,297 | 8/1957 | Wenke | 160/230 |
| 4,736,785 | 4/1978 | Seuster | 160/264 |
| 4,825,921 | 5/1989 | Rigter | 160/271 X |
| 4,834,160 | 5/1989 | Becker | 160/264 X |

FOREIGN PATENT DOCUMENTS 1224175 6/1960 France .

*Primary Examiner*—Carl D. Friedman
*Assistant Examiner*—Korie Chan
*Attorney, Agent, or Firm*—Spensley Horn Jubas & Lubitz

[57] ABSTRACT

The invention relates to a roller blind for windows, doors or the like comprising two curved interlocking profile strips having clamped therebetween flexible hinge straps which extend in a direction vertical to the profile strips and connect same to each other in the vertical direction.

30 Claims, 3 Drawing Sheets

ROLLER BLIND FOR WINDOWS, DOORS OR THE LIKE

This invention relates to a roller blind which is used for windows, doors or the like and comprises curved transverse profile strips which are hingedly connected to and in parallel with each other.

Conventional roller blinds have the disadvantage that they take up a relatively large space in their rolled-up state on a winding roll because of the profile strips which are relatively thick for reasons of stability. As a result, the receiving chamber above a window or a door also occupies a large space.

It is the object of the present invention to provide a roller blind whose transverse strips are thin horizontal profile strips which are easy to manufacture and of high stability, to elastically connect the same by means of space-saving hinge connections, with the roller blind occupying little space in its rolled-up state.

In the case of a roller blind of the above-mentioned type this object of the invention is solved in that two interlocking curved profile strips have clamped therebetween flexible hinge straps which extend in a direction vertical thereto.

Hence, each profile strip of the roller blind which extends in the transverse direction consists of two interlocking curved strips which have clamped therebetween in directly adjacent fashion the vertical hinge straps that connect the superimposed profile strips to each other.

In a preferred embodiment the hinge straps are clamped next to each other in overlapping fashion between the interlocking profiles. If these profile straps are made from steel and have e.g. a thickness of from 0.01 to 0.06 mm, said profile straps can be connected by means of point welding between the profile strips which are also made from steel.

On account of the inventive profile strips which consist of double-type individual profiles, each profile strip exhibits a great stability despite the small thickness which is not considerably increased by the interposed hinge straps extending vertically thereto. Rolled-up roller blinds of this type have only a small total diameter, which has the advantageous effect that considerably less space is now required for accommodating the winding roll.

Other features will become apparent from the subclaims.

The scope of protection does not only comprise the individual features, but also the combination thereof.

Embodiments of the invention are illustrated in the drawing in which

Figure 1:
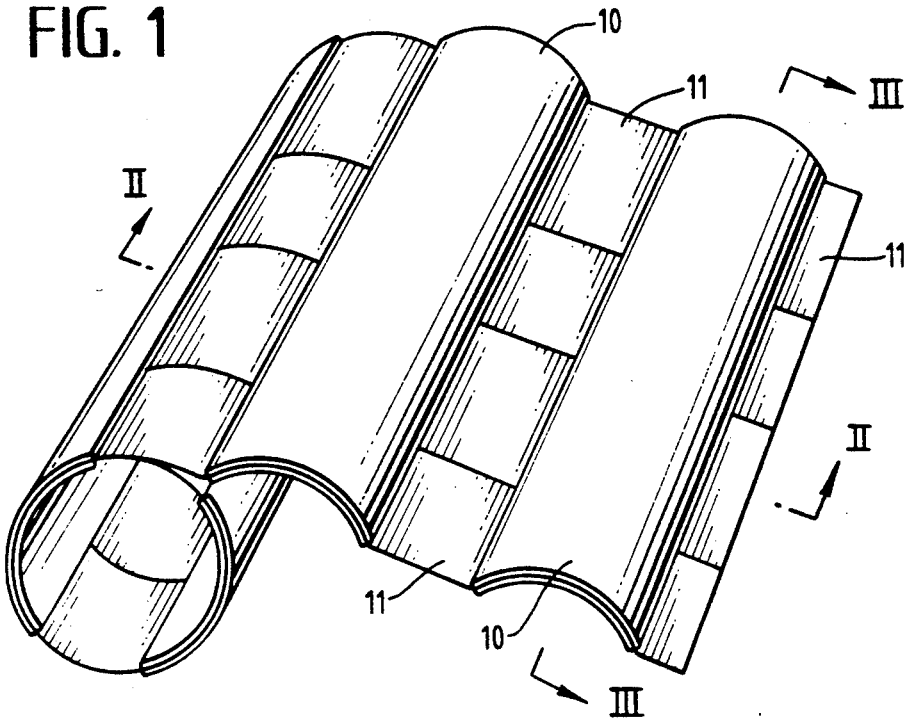
FIG. 1 is a diagrammatic perspective view of a roller blind of the invention in its partly rolled-up state.
Figure 3:
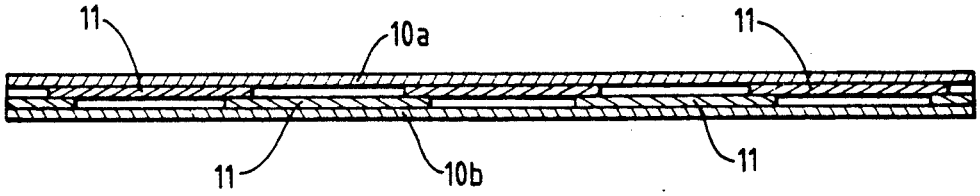
Figure 4:
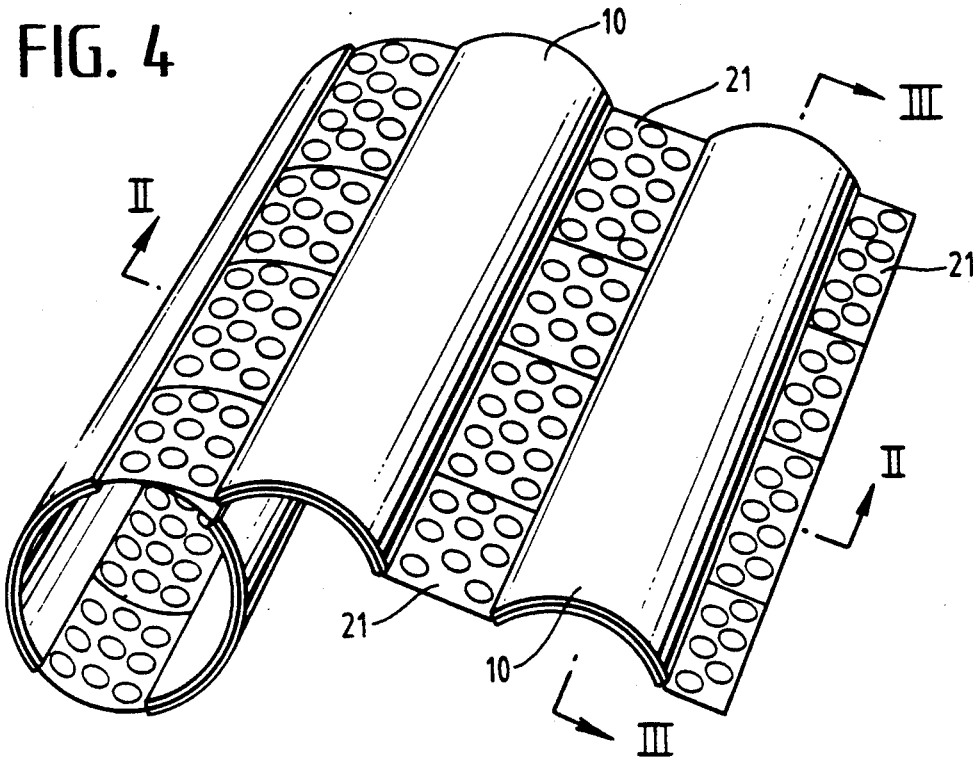
Figure 5:
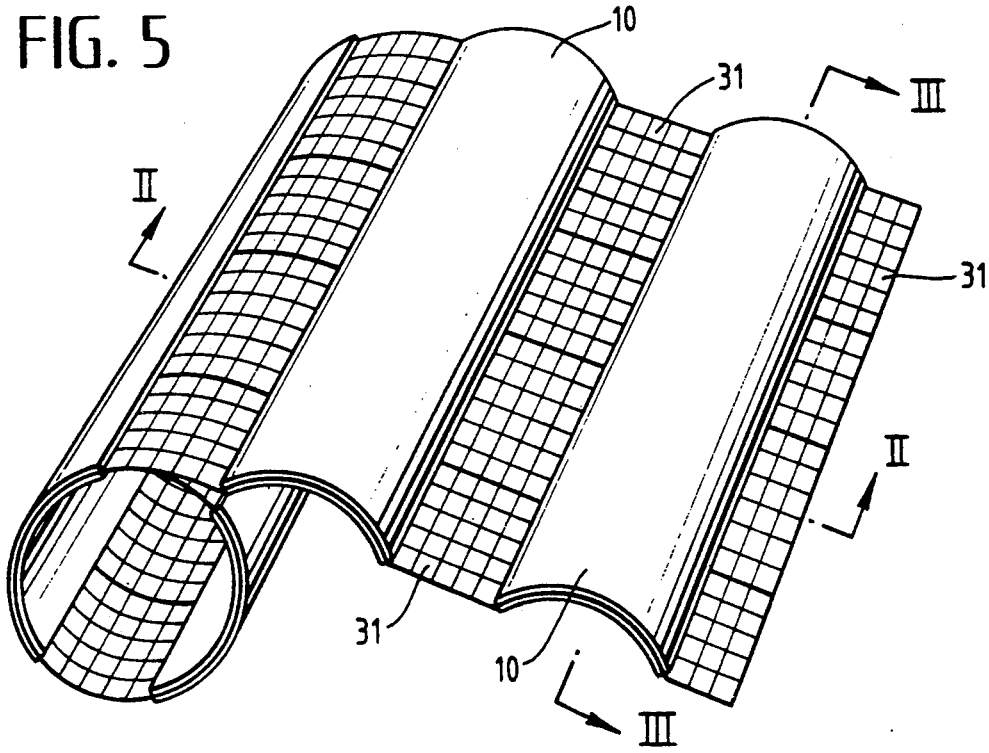
Figure 6:
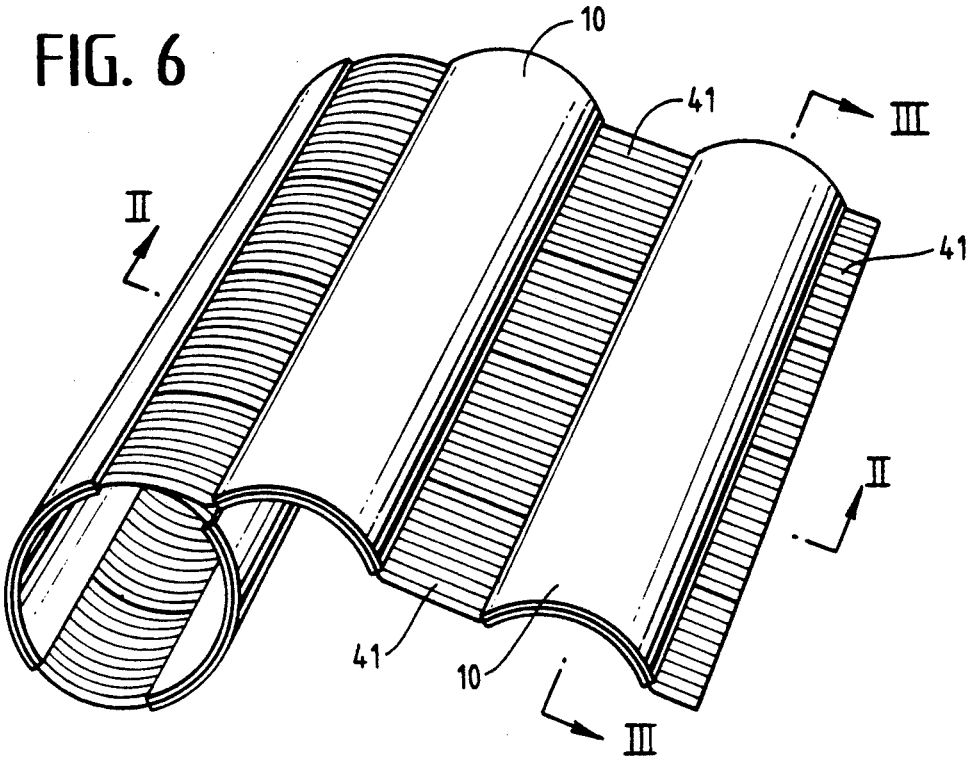
Figure 7:
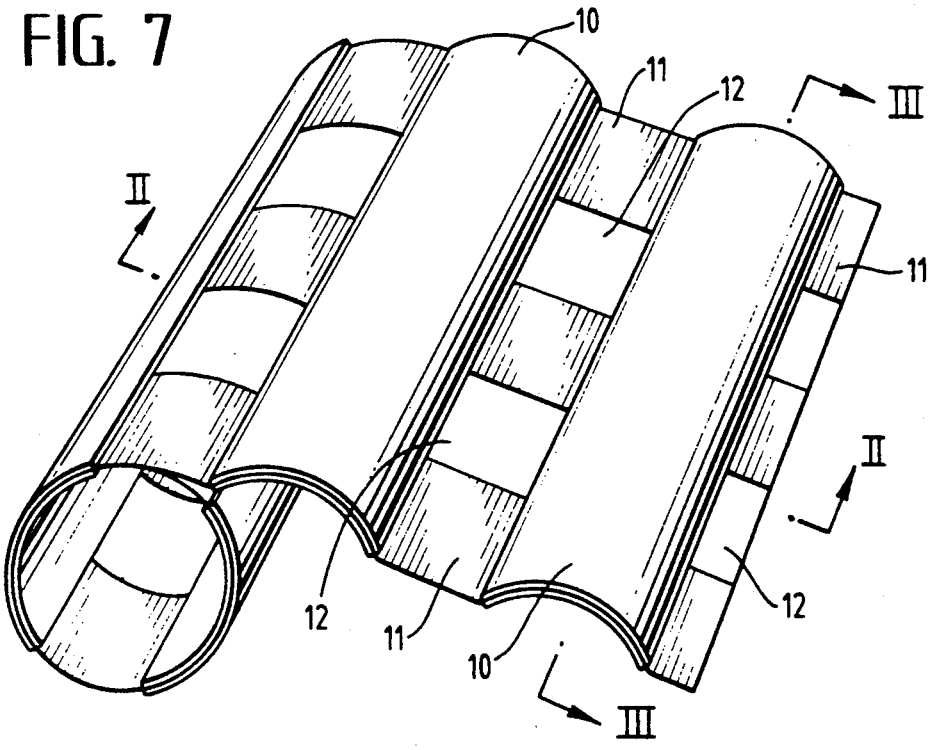

FIG. 3 cross section through a profile strip with clamped, overlapping hinge straps in accordance with section line III—III in FIG. 1;

FIG. 4 is a perspective view of a modified roller blind with perforated hinge straps;

FIG. 5 is a perspective view of another modified roller blind with reticulate hinge straps;

FIG. 6 is a perspective view of a modified roller blind with hinge straps equipped with longitudinal threads;

FIG. 7 is a perspective view of a modified roller blind with hinge straps which leave windows and extend parallel to and in spaced relationship with each other.

(10) designates a plurality of transverse profile strips which extend parallel to each other at specific distances and are hingedly interconnected by means of hinge straps (11) so as to form a roller blind.

Each profile strip (10) consists of two interlocking individual strips (10*a* and 10*b*) as an upper (outer) strip on the one hand and a lower (inner) strip on the other hand, the individual strips being in surface contact with each other and exhibiting a great stability.

Figure 2:
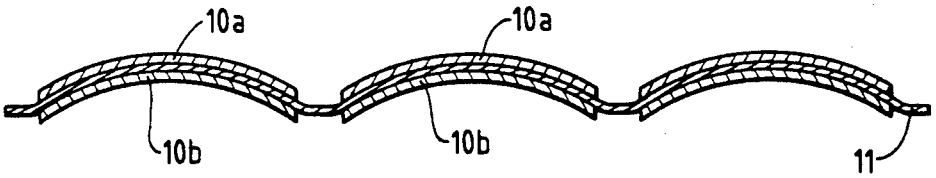
FIG. 2 is a longitudinal section through the same roller blind with transverse profile strips and hinge strap in accordance with section line II—II in FIG. 1.

As shown in FIGS. 2 and 3, small hinge straps (11) which, like the individual strips (10*a*, 10*b*) may consist of V 2 A steel and which extend vertically over the whole length of the roller blind are interposed between these adjacent individual strips (10*a*, 10*b*).

The radius of curvature of the individual strips (10, 10*b*) may e.g. be from 25 to 40 mm. The width of the strips may also amount to about 40 mm.

It is within the scope of the invention to provide strips of different dimensions.

To give the roller blind a certain imperviousness (e.g. to sun rays or wind), it may be advantageous when the width of the hinge straps is preferably between 60 mm and 100 mm and when the straps overlap each other, as shown in FIG. 3.

Steel straps exhibit an excellent elasticity and a great tensile strength.

In accordance with the respective requirements the transverse profile strips (10) have only a small spacing, e.g. 5–15 mm, so that the roller blind is highly resistant to bending without the flexibility between the strips being impaired.

Increased distances of e.g. 30–60 mm considerably reduce the weight and thus the winding diameter.

It is also within the scope of the invention to mount the hinge straps in spaced relationship with and parallel to each other in vertical direction. In this case, however, windows are left between the straps when there are greater distances between the profile strips.

Instead of elastic hinge straps (11) of steel, the hinge straps may also consist of flexible materials such as textiles or plastics. Likewise, the profile strips may be made from a plastic material. With a low-weight construction the outer or inner strip may be made from a plastic material and the associated profile strip from steel.

To connect two profile strips (10*a*, 10*b*) to each other, the outer profile strip may preferably have a smaller radius of curvature, so that the longitudinal edges of the interlocking profile strips (10*a*, 10*b*) are pressed against each other.

Instead of point welding the profile strips (10*a*, 10*b*) may be bonded by means of an adhesive to the hinge straps (11) extending in a direction transverse thereto.

FIG. 3 is only meant to show the basic overlapping configuration. The drawing is not true to scale.

The individual steel-made profile strips and hinge straps (11), respectively, have a preferred thickness of from 0.01 to 0.06 mm according to the respectively desired flexibility of the hinge straps or the strength of the profile strips (10*a*, 10*b*).

In comparison with known profile strips there is a considerably reduced thickness on the one hand and a substantial decrease in weight on the other hand, and nevertheless the same strength or even an improved strength.

High strength values can be achieved for the plastic profile strips (10) by means of a carbon or fiber reinforcement.

It is also within the scope of the invention to form the hinge straps from perforated sheets, from grids such as wire grids, in particular woven wire mesh, from synthetic threads, or the like. They may also consist of a fabric of synthetic threads.

FIG. 4 shows a roller blind with curved profile strips (10) which are flexibly connected to each other by means of perforated steel or plastic straps (21).

In the embodiment of FIG. 5 adjacent straps (31) consisting of net-like strips or grid strips hold the curved profile strips (10).

As shown in FIG. 6, the curved profile strips (10) are held together by means of straps (41) consisting of longitudinally oriented (parallel) threads of textile fibers or metal.

According to FIG. 7 the steel straps (11) are parallel to and in spaced relationship with each other in such a way that windows (12) are formed therebetween.

The embodiments shown in FIGS. 4–7 have in common that the spaces (12) between the parallel profile strips (10) are permeable to air on the one hand and guarantee a view on the other hand when there are greater dimensions.

The width of the hinge straps may also amount to 100 to 200 cm. The distances of the profile strips may be increased to lie between 80 and 120 mm.

I claim:

1. A roller blind for windows and doors, comprising a plurality of curved profile strips which are hingedly connected to and in parallel with each other, characterized in that a pair of interlocking profile strips have clamped therebetween flexible discrete hinge straps which extend in a direction vertical to said profile strips and connect said strips to each other in the vertical direction, wherein said plurality of profile strips are interconnected by said flexible hinge straps, wherein the profile strips are broader than the hinge straps, and wherein each discrete hinge strap is clamped between more than two pairs of interlocking profile strips.

2. A roller blind according to claim 1, characterized in that said hinge straps are clamped between said interlocking profile strips in vertical direction next to each other and in overlapping fashion.

3. A roller blind according to claim 1, characterized in that said hinge straps are made from an elastic steel and have a thickness of from 0.01 to 0.06 mm.

4. A roller blind according to claim 1, characterized in that said hinge straps have a thickness of from 0.2 to 0.3 mm.

5. A roller blind according to claim 1, characterized in that said hinge straps have a width of from 50 to 100 mm.

6. A roller blind according to claim 1, characterized in that said profile strips and/or said hinge straps are made from stainless steel.

7. A roller blind according to claim 1, characterized in that said profile strips are made from a plastic material.

8. A roller blind according to claim 1, characterized in that said profile strips are curved with a radius of from 20 to 40 mm.

9. A roller blind according to claim 1, characterized in that the curvature of said outer profile strip is smaller than the curvature of said inner profile strip.

10. A roller blind according to claim 1, characterized in that one member of said pair of interlocking profile strips is made from a plastic material and the other one from steel.

11. A roller blind according to claim 1, characterized in that said flexible hinge straps are made from textile materials.

12. A roller blind according to claim 1, characterized in that said flexible hinge straps are formed by glass fiber and/or carbon-reinforced plastic straps.

13. A roller blind according to claim 1, characterized in that said hinge straps are point welded to said profile strips between said profile strips.

14. A roller blind according to claim 1, characterized in that said hinge straps and said profile strips are bonded to each other by means of an adhesive.

15. A roller blind according to claim 1, characterized in that said hinge straps consist of a grid made from wire or synthetic threads.

16. A roller blind according to claim 1, characterized in that said hinge straps have a width of from 100 to 200 cm.

17. A roller blind according to claim 1, characterized in that said profile strips are connected to said hinge straps at a distance of between 80 and 120 mm from one another.

18. A roller blind for windows and doors, comprising curved profile strips which are hingedly connected to and in parallel with each other, wherein two interlocking profile strips have clamped therebetween flexible hinge straps which extend in a direction vertical to said profile strips and connect said strips to each other in the vertical direction and wherein said hinge straps are clamped between said interlocking profile strips in vertical direction next to each other and in overlapping fashion.

19. A roller blind according to claim 18, wherein said hinge straps are made from an elastic steel and have a thickness of from 0.01 to 0.06 mm.

20. A roller blind according to claim 18, wherein said hinge straps have a thickness of from 0.2 to 0.3 mm.

21. A roller blind according to claim 18, wherein said hinge straps have a width of from 50 to 100 mm.

22. A roller blind according to claim 18, wherein said profile strips are curved with a radius of from 20 to 40 mm.

23. A roller blind according to claim 18, wherein said hinge straps have a width of from 100 to 200 cm.

24. A roller blind according to claim 18, wherein said profile strips are connected to said hinge straps at a distance of between 80 and 120 mm from one another.

25. A roller blind comprising:

at least two adjacent pairs of curved profile strips, each member of each pair being adjacent to and parallel to the other member of such pair, one member of each pair having an exposed side and an unexposed side; and a flexible strap having two sides, the strap sandwiched between the members of each pair of curved profile strips, wherein the exposed surface area of the exposed side of the profile strip member is greater than the exposed surface area of one side of the strap between adjacent pairs of profile strips.

26. The roller blind of claim 25, wherein the flexible strap as a length and a width and wherein the strap is continuous throughout its length.

27. The roller blind of claim 25, further including a second flexible strap, wherein said two flexible straps at least partially overlap each other.

28. A roller blind for windows and doors, comprising at least two curved profile strips which are hingedly connected to and in parallel with each other, wherein a pair of interlocking profile strips have clamped therebetween continuous flexible discrete hinge straps which extend in a direction vertical to said profile strips and connect said strips to each other in the vertical direction, wherein the profile strips are broader than the hinge straps, and wherein each discrete hinge strap is clamped between more than two pairs of interlocking profile strips.

29. A roller blind for windows doors, comprising curved profile strips which are hingedly connected to and in parallel with each other, wherein a pair of interlocking profile strips have clamped therebetween discrete flexible hinge straps which extend in a direction vertical to said profile strips and connect said strips to each other in the vertical direction, wherein said profile strips and/or said profile straps are made from stainless steel, wherein the profile strips are broader than the hinge straps, and wherein each discrete hinge strap is clamped between more than two pairs of interlocking profile strips.

30. A roller blind for windows and doors, comprising curved profile strips which are hingedly connected to and in parallel with each other, wherein a pair of interlocking profile strips have clamped therebetween discrete flexible hinge straps which extend in a direction vertical to said profile strips and connect said strips to each other in the vertical direction, wherein said hinge straps are point welded to said profile strips between said profile strips, wherein the profile strips are broader than the hinge straps, and wherein each discrete hinge strap is clamped between more than two pairs of interlocking profile strips.

* * * * *